US009257267B2

(12) United States Patent
Dey et al.

(10) Patent No.: US 9,257,267 B2
(45) Date of Patent: Feb. 9, 2016

(54) COMPOSITION, METHOD, AND KIT FOR CALIBRATING A MASS SPECTROMETER

(75) Inventors: Subhakar N. Dey, Lexington, MA (US); Marjorie S. Minkoff, Brookline, MA (US); Sasi K. Pillai, Littleton, MA (US); Subhasish Purkayastha, Acton, MA (US); Brian L. Williamson, Ashland, MA (US)

(73) Assignee: DH Technologies Development Pte. Ltd., Singapore (SG)

( * ) Notice: Subject to any disclaimer, the term of this patent is extended or adjusted under 35 U.S.C. 154(b) by 191 days.

(21) Appl. No.: 14/008,884

(22) PCT Filed: Mar. 30, 2012

(86) PCT No.: PCT/US2012/031553

§ 371 (c)(1),
(2), (4) Date: Sep. 30, 2013

(87) PCT Pub. No.: WO2012/135682

PCT Pub. Date: Oct. 4, 2012

(65) Prior Publication Data

US 2014/0027625 A1 Jan. 30, 2014

Related U.S. Application Data

(60) Provisional application No. 61/470,275, filed on Mar. 31, 2011.

(51) Int. Cl.
*H01J 49/00* (2006.01)

(52) U.S. Cl.
CPC ..... *H01J 49/0009* (2013.01); *H01J 49/0027* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,872,357 | A * | 2/1999 | Flanagan | H01J 49/0009 250/252.1 |
| 6,767,887 | B1 | 7/2004 | Hoffman et al. | |
| 2003/0199431 | A1 | 10/2003 | Neilsen et al. | |
| 2009/0152455 | A1 | 6/2009 | Wang et al. | |

OTHER PUBLICATIONS

Cody et al., Electrospray Ionization/Magnetic Sector Mass Spectrometry: Calibration, Resolution, and Accurate Mass Measurements, Jul. 15, 1992, Analytical Chemistry, vol. 64, pp. 1561-1571.*
Lu et al. Using Amino Acids for Probing Structural Information of Cytochrome c by Electrospray Ionization Mass Spectrometry, Sep. 16, 2004, J. Am. Soc. Mass Spectrometry, vol. 15, pp. 1612-1615.*
Wong et al., Multiple Charging in Electrospray Ionization of Poly(ethylene glycols), 1988, J. Phys. Chem., vol. 92, pp. 546-550.*
Garafolo, Fabio, LC-MS Instrument Calibration, Analytical Method Validation and Instrument Performance Verification, 2004, pp. 197-220.*

(Continued)

*Primary Examiner* — Christine Sung

(57) ABSTRACT

A composition, method, and kit for calibrating a mass spectrometer including a predetermined concentration of a calibrant having a mixture of amino acid polyethylene glycol compounds and a solvent for dissolving the calibrant. The calibrant can be used in either positive or negative ionization mode, and it can be used in calibrating an atmospheric pressure chemical ionization or an electrospray mass spectrometer. The calibrant can include a mixture to enable calibration across a broad range of masses.

13 Claims, 20 Drawing Sheets

(56) References Cited

OTHER PUBLICATIONS

What is dPEG [online], [retrieved on Sep. 22, 2015]. Retrieved from the internet: <URL http://www.quantabiodesign.com/what-is-dpeg/, pp. 1-6>.*

AB Sciex Triple TOF 6600 System: System User Guid [Retreieved on Sep. 22, 2015]. Retrieved from the internet: <URL http://sciex.com/Documents/manuals/6600-system-user-guide-en.pdf>.*

International Preliminary Report of Patentability of International Patent Application No. PCT/US2012/031553, dated Mar. 18, 2014.

* cited by examiner

| APCI Positive Calibration Solution | | | | | | | |
|---|---|---|---|---|---|---|---|
| **Name** | **Formula (M)** | **CAS** | **Sigma** | **QuantaBiodesign** | **Apollo** | **FW** | **molarity** |
| 7-aminoheptanoic acid | C7H15NO2 | 929-17-9 | 284637 | | | 145.2 | 6.89E-06 |
| amino-dPEG 4-acid | C11H23NO6 | | | 10244 | | 265.3 | 5.65E-07 |
| clomipramine | C19H23ClN2.HCl | 17321-77-6 | C7291 | | | 351.31 | 4.98E-07 |
| amino-dPEG 6-acid | C15H31NO8 | | | 10067 | | 353.41 | 2.12E-07 |
| amino-dPEG 8-acid | C18H39NO10 | 756526-04-2 | | 10277 | | 441.51 | 1.93E-07 |
| Reserpine | C33H40N2O9 | 50-55-5 | R0875 | | | 608.68 | 6.24E-07 |
| amino-dPEG 12-acid | C27H55NO14 | 756526-07-5 | | 10287 | | 617.72 | 4.61E-07 |
| phosphazene 921 | C18H18F24N3O6P3 | 58943-98-9 | | | PC0874 | 921.23 | 3.05E-07 |
| phosphazene 1521 | C30H18F48N3O6P3 | 16059-16-8 | | | PC0233 | 1521.33 | 3.29E-07 |

Figure 2

Positive Ion Spectra (APCI)

Positive MS/MS - clomipramine

Peak List for " +TOF Product (315.1): Exp 2, 3.4576 to 3.4880 min from Sample 2 (p9 ext-002) of P9 ext cal 1-10.wiff different calibrations (DuoSpray ())"

| | Target Mass (Da) | Found At (Da) | Intensity (cps) | Width (Da) | Mass Shift (ppm) |
|---|---|---|---|---|---|
| 1 | 58.06510 | 58.06514 | 229.75000 | 3.46332e-3 | 0.61821 |
| 2 | 86.09640 | 86.09669 | 595.25000 | 4.51873e-3 | 3.32002 |
| 3 | 242.07310 | 242.07333 | 163.25000 | 6.59812e-3 | 0.93436 |
| 4 | 270.10440 | 270.10442 | 74.00000 | 6.52390e-3 | 0.09250 |
| 5 | 315.16225 | 315.16281 | 301.25000 | 0.01107 | 1.79036 |

Positive MS/MS - reserpine

Peak List for " +TOF Product (609.3): Exp 4, 3.5116 to 3.5622 min from Sample 2 (p9 ext-002) of P9 ext cal 1-10.wiff different calibrations (DuoSpray ())"

| | Target Mass (Da) | Found At (Da) | Intensity (cps) | Width (Da) | Mass Shift (ppm) |
|---|---|---|---|---|---|
| 1 | 174.09134 | 174.09134 | 973.16667 | 5.81520e-3 | -5.08661e-3 |
| 2 | 195.06519 | 195.06526 | 1607.33333 | 6.97402e-3 | 0.35452 |
| 3 | 236.12812 | 236.12807 | 214.00000 | 8.28324e-3 | -0.22371 |
| 4 | 365.18597 | 365.18594 | 256.66667 | 9.01847e-3 | -0.06985 |
| 5 | 397.21218 | 397.21206 | 898.33333 | 0.01161 | -0.29162 |
| 6 | 448.19659 | 448.19666 | 428.83333 | 0.01357 | 0.14703 |
| 7 | 609.28066 | 609.28038 | 1610.16667 | 0.01723 | -0.46416 |

Positive MS/MS - verapamil

Peak List for " +TOF Product (455.3): Exp 3, 3.2771 to 3.3176 min from Sample 2 (p9 ext-002) of P9 ext cal 1-10.wiff different calibrations (DuoSpray ())"

| | Target Mass (Da) | Found At (Da) | Intensity (cps) | Width (Da) | Mass Shift (ppm) |
|---|---|---|---|---|---|
| 1 | 150.06750 | 150.06758 | 357.20000 | 5.41248e-3 | 0.52211 |
| 2 | 165.09100 | 165.09105 | 1702.20000 | 5.86509e-3 | 0.27327 |
| 3 | 260.16450 | 260.16438 | 128.40000 | 9.35211e-3 | -0.46927 |
| 4 | 303.20670 | 303.20672 | 409.20000 | 9.85796e-3 | 0.05382 |
| 5 | 455.29040 | 455.29041 | 679.40000 | 0.01383 | 0.01755 |

| APCI Negative Calibration Solution | | | | | | |
|---|---|---|---|---|---|---|
| Name | Formula (M) | CAS | Sigma | QuantaBiodesign | FW | molarity |
| 7-aminoheptanoic acid | C7H15NO2 | 929-17-9 | 284637 | | 145.2 | 6.89E-06 |
| amino-dPEG 4-acid | C11H23NO6 | | | 10244 | 265.3 | 9.42E-07 |
| amino-dPEG 6-acid | C15H31NO8 | | | 10067 | 353.41 | 7.07E-07 |
| sulfinpyrazone | C23H20N2O3S | 57-96-5 | S9509 | | 404.48 | 8.65E-07 |
| amino-dPEG 8-acid | C18H39NO10 | 756526-04-2 | | 10277 | 441.51 | 2.83E-07 |
| amino-dPEG 12-acid | C27H55NO14 | 756526-07-5 | | 10287 | 617.72 | 4.61E-07 |
| amino-dPEG 16-acid | C35H71NO18 | | | 10297 | 793.93 | 7.87E-07 |

Figure 8

Negative MS/MS Calibration - sulfinpyrazone

Peak List for " -TOF Product (403.1): Exp 2, 0.6881 to 1.5184 min from Sample 1 (cal) of Cal20100716101210100.wiff different calibrations (DuoSpray ())"

| | Target Mass (Da) | Found At (Da) | Intensity (cps) | Width (Da) | Mass Shift (ppm) |
|---|---|---|---|---|---|
| 1 | 125.00670 | 125.00655 | 558.60484 | 5.72890e-3 | -1.21656 |
| 2 | 277.09830 | 277.09856 | 929.92742 | 9.92787e-3 | 0.95440 |
| 3 | 403.11219 | 403.11195 | 787.56452 | 0.01447 | -0.58312 |

| ESI Positive Calibration Solution | | | | | | | |
|---|---|---|---|---|---|---|---|
| Name | Formula (M) | CAS | Sigma | QuantaBiodesign | Apollo | FW | molarity |
| 7-aminoheptanoic acid | C7H15NO2 | 929-17-9 | 284637 | | | 145.2 | 3.44E-06 |
| amino-dPEG 4-acid | C11H23NO6 | | | 10244 | | 265.3 | 2.83E-07 |
| clomipramine | C19H23ClN2.HCl | 17321-77-6 | C7291 | | | 351.31 | 2.49E-07 |
| amino-dPEG 6-acid | C15H31NO8 | | | 10067 | | 353.41 | 1.06E-07 |
| amino-dPEG 8-acid | C18H39NO10 | 756526-04-2 | | 10277 | | 441.51 | 9.63E-08 |
| Reserpine | C33H40N2O9 | 50-55-5 | R0875 | | | 608.68 | 1.25E-06 |
| amino-dPEG 12-acid | C27H55NO14 | 756526-07-5 | | 10287 | | 617.72 | 1.15E-08 |
| phosphazene 921 | C18H18F24N3O6P3 | 58943-98-9 | | | PC0874 | 921.23 | 3.05E-06 |
| phosphazene 1521 | C30H18F48N3O6P3 | 16059-16-8 | | | PC0233 | 1521.33 | 3.29E-06 |

Figure 13

ESI Positive

| ESI Negative Calibration Solution | | | | | | |
|---|---|---|---|---|---|---|
| Name | Formula (M) | CAS | Sigma | QuantaBiodesign | FW | molarity |
| 7-aminoheptanoic acid | C7H15NO2 | 929-17-9 | 284637 | | 145.2 | 6.89E-06 |
| amino-dPEG 4-acid | C11H23NO6 | | | 10244 | 265.3 | 9.42E-07 |
| amino-dPEG 6-acid | C15H31NO8 | | | 10067 | 353.41 | 7.07E-07 |
| sulfinpyrazone | C23H20N2O3S | 57-96-5 | S9509 | | 404.48 | 1.24E-07 |
| amino-dPEG 8-acid | C18H39NO10 | 756526-04-2 | | 10277 | 441.51 | 2.83E-07 |
| amino-dPEG 12-acid | C27H55NO14 | 756526-07-5 | | 10287 | 617.72 | 4.61E-07 |
| amino-dPEG 16-acid | C35H71NO18 | | | 10297 | 793.93 | 7.87E-07 |

Figure 16

1 ug/mL Mix, Negative ESI

ESI Negative

Peak List for '-TOF MS: 0.4072 to 0.6666 min from Sample 2 (lc 1 ml/min in apci, cal through esi, 500 uL/min, after cal) of neg solution ESI mode.wiff different calibrations (DuoSpray ())'

| | Target Mass (Da) | Found At (Da) | Intensity (cps) | Width (Da) | Mass Shift (ppm) |
|---|---|---|---|---|---|
| 1 | 144.10300 | 144.10294 | 8124.21053 | 6.07678e-3 | -0.44676 |
| 2 | 264.14526 | 264.14490 | 1.61498e4 | 9.31391e-3 | -1.37665 |
| 3 | 352.19769 | 352.19719 | 4.00395e4 | 0.01193 | -1.42600 |
| 4 | 403.11219 | 403.11282 | 3.68817e5 | 0.01350 | 1.57359 |
| 5 | 440.25012 | 440.24888 | 2.62608e4 | 0.01510 | -2.80881 |
| 6 | 616.35498 | 616.35397 | 4.39129e4 | 0.02079 | -1.63754 |
| 7 | 792.45984 | 792.45922 | 2.88671e4 | 0.02739 | -0.78555 |

COMPOSITION, METHOD, AND KIT FOR CALIBRATING A MASS SPECTROMETER

RELATED APPLICATION

This application claims priority to U.S. provisional application No. 61/470,275 filed Mar. 31, 2011, which is incorporated herein by reference in its entirety.

FIELD

The applicants' teachings relate to a composition, method, and kit for calibrating a mass spectrometer.

INTRODUCTION

To achieve accuracy and reliability, mass spectrometers need to be calibrated. Although there are a variety of calibrants used to calibrate mass spectrometers, many of them do not span a large mass range, do not work in both positive and negative ion modes, and are not ionizable in both electrospray (PSI) and atmospheric pressure ionization (APCI) modes. Typically, multiple sets of compounds are used that work either in positive or negative ion mode and either in ESI or APCI mode.

SUMMARY

In accordance with an aspect of the applicants' teachings, a calibration composition for use in mass spectrometry is provided. The system comprises a predetermined concentration of a calibrant comprising a mixture of amino acid polyethylene glycol compounds, also known as discrete polyethylene glycol (dPEG®) compounds, and a solvent for dissolving the calibrant. In various embodiments, the calibrant can be used in either positive or negative ionization mode. In various embodiments, the calibrant can be used in calibrating an atmospheric pressure chemical ionization (APCI) or an electrospray mass spectrometer. In various embodiments, the calibrant composition comprises a mixture to enable calibration across a range of approximately 145 to 3500 Da. In various aspects, in calibrating an APCI mass spectrometer in positive ionization mode, the polyethylene glycol compounds comprise amino-dPEG 4-acid, amino-dPEG 6-acid, amino-dPEG 8-acid, and amino-dPEG 12-acid. In various embodiments, the calibrant further comprises 7-aminoheptanoic acid, clomipramine, reserpine, phosphazene 921, and phosphazene 1521. In various aspects, the solvent comprises a mixture of acetonitrile and water, but any suitable solvent can be used. In various aspects, in calibrating an APCI mass spectrometer in negative ionization mode, the polyethylene glycol compounds comprise amino-dPEG 4-acid, amino-dPEG 6-acid, amino-dPEG 8-acid, amino-dPEG 12-acid, and amino-dPEG 16-acid. In various embodiments, the calibrant further comprises 7-aminoheptanoic acid and sulfinpyrazone. In various aspects, the solvent comprises a mixture of acetonitrile and water, but any suitable solvent can be used. In various embodiments, in calibrating an electrospray mass spectrometer in positive ionization mode, the polyethylene glycol compounds comprise amino-dPEG 4-acid, amino-dPEG 6-acid, amino-dPEG 8-acid, and amino-dPEG 12-acid. In various embodiments, the calibrant further comprises 7-aminoheptanoic acid, clomipramine, reserpine, phosphazene 921, and phosphazene 1521. In various aspects, the solvent comprises a mixture of acetonitrile and water, but any suitable solvent can be used. In various embodiments, in calibrating an electrospray mass spectrometer in negative ionization mode, the polyethylene glycol compounds comprise amino-dPEG 4-acid, amino-dPEG 6-acid, amino-dPEG 8-acid, amino-dPEG 12-acid, and amino-dPEG 16-acid. In various embodiments, the calibrant further comprises 7-aminoheptanoic acid and sulfinpyrazone. In various aspects, the solvent comprises a mixture of acetonitrile and water, but any suitable solvent can be used.

In various aspects, a method for calibrating a mass spectrometer is provided. The method comprises obtaining a mass spectrum of a calibrant composition containing a plurality of known compounds comprising a mixture of amino acid polyethylene glycol compounds, also known as discrete polyethylene glycol (dPEG®) compounds, and a solvent for dissolving the calibrant, determining the differences between the expected mass peaks for the known compounds and the corresponding actual mass peaks obtained, and adjusting the mass spectrometer based on the differences between the expected and actual mass peaks. In various embodiments, the calibrant can be used in either positive or negative ionization mode. In various embodiments, the calibrant can be used in calibrating an atmospheric pressure chemical ionization (APCI) or an electrospray mass spectrometer. In various embodiments, the calibrant mixture is selected to enable calibration across a range of approximately 145 to 3500 Da. In various aspects, in calibrating an APCI mass spectrometer in positive ionization mode, the polyethylene glycol compounds comprise amino-dPEG 4-acid, amino-dPEG 6-acid, amino-dPEG 8-acid, and amino-dPEG 12-acid. In various embodiments, the calibrant further comprises 7-aminoheptanoic acid clomipramine, reserpine, phosphazene 921, and phosphazene 1521. In various aspects, the solvent comprises a mixture of acetonitrile and water, but any suitable solvent can be used. In various aspects, in calibrating an APCI mass spectrometer in negative ionization mode, the polyethylene glycol compounds comprise amino-dPEG 4-acid, amino-dPEG 6-acid, amino-dPEG 8-acid, amino-dPEG 12-acid, and amino-dPEG 16-acid. In various embodiments, the calibrant further comprises 7-aminoheptanoic acid and sulfinpyrazone. In various aspects, the solvent comprises a mixture of acetonitrile and water, but any suitable solvent can be used. In various embodiments, in calibrating an electrospray mass spectrometer in positive ionization mode, the polyethylene glycol compounds comprise amino-dPEG 4-acid, amino-dPEG 6-acid, amino-dPEG 8-acid, and amino-dPEG 12-acid. In various embodiments, the calibrant further comprises 7-aminoheptanoic acid clomipramine, reserpine, phosphazene 921, and phosphazene 1521. In various aspects, the solvent comprises a mixture of acetonitrile and water, but any suitable solvent can be used. In various embodiments, in calibrating an electrospray mass spectrometer in negative ionization mode, the polyethylene glycol compounds comprise amino-dPEG 4-acid, amino-dPEG 6-acid, amino-dPEG 8-acid, amino-dPEG 12-acid, and amino-dPEG 16-acid. In various embodiments, the calibrant further comprises 7-aminoheptanoic acid and sulfinpyrazone. In various aspects, the solvent comprises a mixture of acetonitrile and water, but any suitable solvent can be used.

In various aspects, a kit for calibrating a mass spectrometer is provided comprising a predetermined concentration of a calibrant comprising a mixture of amino acid polyethylene glycol compounds, also known as discrete polyethylene glycol (dPEG) compounds, and a solvent for dissolving the calibrant. In various embodiments, the calibrant comprises a mixture to enable calibration across a range of approximately 145 to 3500 Da. In various aspects, in calibrating an atmospheric pressure chemical ionization (APCI) mass spectrometer in positive ionization mode, the polyethylene glycol compounds comprise amino-dPEG 4-acid, amino-dPEG 6-acid, amino-dPEG 8-acid, and amino-dPEG 12-acid. In various embodiments, the calibrant further comprises 7-aminoheptanoic acid, clomipramine, reserpine, phosphazene 921, and phosphazene 1521. In various aspects, the solvent comprises a mixture of acetonitrile and water, but any suitable solvent can be used. In various aspects, in calibrating an atmospheric pressure chemical ionization (APCI) mass spectrometer in negative ionization mode, the polyethylene glycol compounds comprise amino-dPEG 4-acid, amino-dPEG 6-acid, amino-dPEG 8-acid, amino-dPEG 12-acid, and amino-dPEG 16-acid. In various embodiments, the calibrant further comprises 7-aminoheptanoic acid and sulfinpyrazone. In various aspects, the solvent comprises a mixture of acetonitrile and water, but any suitable solvent can be used. In various embodiments, in calibrating an electrospray mass spectrometer in positive ionization mode, the polyethylene glycol compounds comprise amino-dPEG 4-acid, amino-dPEG 6-acid, amino-dPEG 8-acid, and amino-dPEG 12-acid. In various embodiments, the calibrant further comprises 7-aminoheptanoic acid, clomipramine, reserpine, phosphazene 921, and phosphazene 1521. In various aspects, the solvent comprises a mixture of acetonitrile and water, but any suitable solvent can be used. In various embodiments, in calibrating an electrospray mass spectrometer in negative ionization mode, the polyethylene glycol compounds comprise amino-dPEG amino-dPEG 6-acid, amino-dPEG 8-acid, amino-dPEG 12-acid, and amino-dPEG 16-acid. In various embodiments, the calibrant further comprises 7-aminoheptanoic acid and sulfinpyrazone. In various aspects, the solvent comprises a mixture of acetonitrile and water, but any suitable solvent can be used.

These and other features of the applicants' teachings are set forth herein.

BRIEF DESCRIPTION OF THE DRAWINGS

The skilled person in the art will understand that the drawings, described below, are for illustration purposes only. The drawings are not intended to limit the scope of the applicants' teachings in anyway.

FIG. 2 shows a table of a calibration composition for an APCI ion source in positive ionization mode in accordance with various embodiments of the applicants' teachings.

FIG. 8 shows a table of a calibration composition for an APCI ion source in negative ionization mode in accordance with various embodiments of the applicants' teachings.

FIG. 13 shows a table of a calibration composition for an ESI ion source in positive ionization mode in accordance with various embodiments of the applicants' teachings.

FIG. 16 shows a table of a calibration composition for an APCI ion source in negative ionization mode in accordance with various embodiments of the applicants' teachings.

DESCRIPTION OF VARIOUS EMBODIMENTS

It should be understood that the phrase "a" or "an" used in conjunction with the applicants' teachings with reference to various elements encompasses "one or more" or "at least one" unless the context clearly indicates otherwise. In various embodiments, a calibration composition comprises a predetermined concentration of a calibrant comprising a mixture of amino acid polyethylene glycol compounds or discrete polyethylene glycol (dPEG®) compounds in a solvent that can dissolve the calibrant and any other components that can be present in the composition. In various embodiments, the calibrant composition can be used in positive or negative ionization mode. In various aspects, certain calibrant compositions can be better suited for use in positive ionization mode while others can be better for use in negative ionization mode. In various embodiments, the calibrant composition can be used in calibrating a mass spectrometer with an atmospheric pressure chemical ionization (APCI) mass spectrometer or a mass spectrometer with an electrospray (ESI) ion source. In various embodiments, a calibrant composition can be selected to enable calibration across a broad mass range and can provide reference mass peaks in both positive and negative ionization modes. In various aspects, substantially the same components can be used for both APCI and electrospray mass spectrometry. To provide calibration across a broad mass range, the calibrant composition can comprise a mixture of different discrete polyethylene glycol compounds in accordance with various embodiments of the applicant's teachings. In various aspects, the calibrant composition can enable calibration across a range of approximately 145 to 3500 Da. In various aspects, the solvent to dissolve the calibrant can comprise a mixture of acetonitrile and water, but any suitable solvent can be used.

Figure 1:
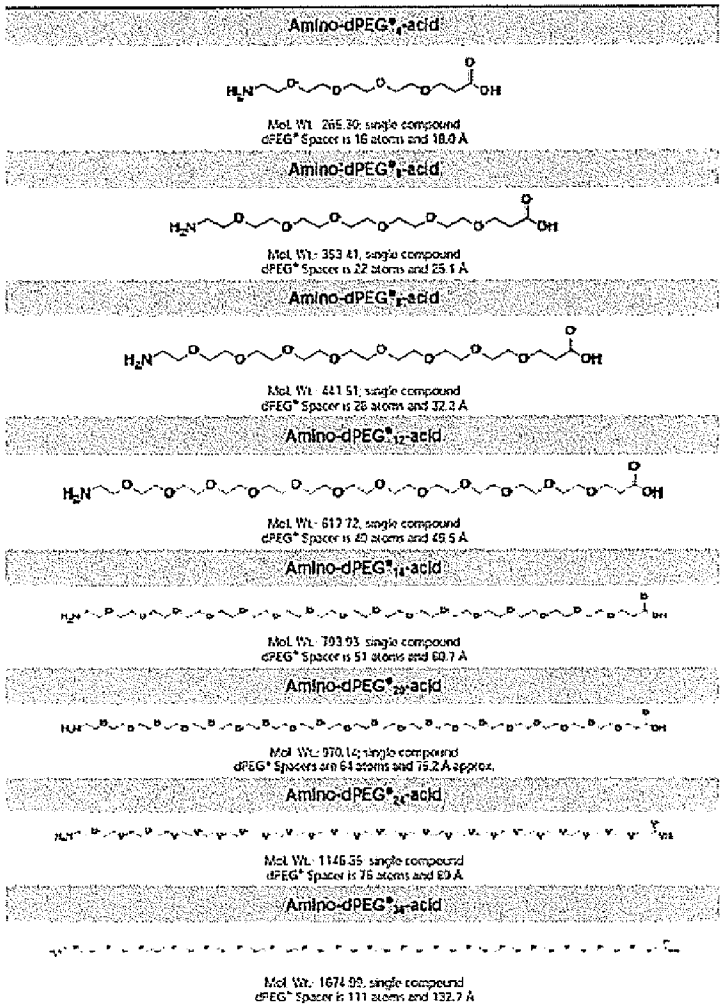
FIG. 1 shows the molecular structure of discrete polyethylene compounds in accordance with various embodiments of the applicants' teachings.

Reference is made to FIG. 1 which shows the molecular structure of discrete polyethylene glycol compounds that can comprise the calibrant composition in accordance with various embodiments of the applicants' teachings. In various aspects, the calibrant composition can include, but is not limited to, the discrete polyethylene glycol compounds shown in FIG. 1. In various embodiments, as shown in FIG. 1, the calibration composition can comprise a mixture of discrete length polyethylene glycol compounds having an amino group on one end, a number of ethylene oxide units, and a carboxylic acid group on the other end, known also as amino-dPEG$_n$-acids, wherein n is the number of ethylene oxide units. For example, amino-dPEG$_4$-acid has an amino group on one end, four ethylene oxide units, and a carboxylic acid group on the other end, as shown in FIG. 1. In various embodiments, n can be in the range of 4 to 16. In various aspects, the calibrant composition comprises a mixture of different amino-dPEG-acid compounds that can be selected to span across a broad mass range. In various embodiments, approximately four to five amino-dPEG-acid compounds can be used in the calibration composition. For example, the following amino-dPEG-acid compounds in the calibration composition can include, but are not limited to, amino-dPEG$_4$-acid, amino-dPEG$_6$-acid, amino-dPEG$_8$-acid, amino-dPEG$_{12}$-acid, and amino-dPEG$_{16}$-acid. The amino-dPEG-acid compounds can be obtained commercially from QuantaBiodesign. In various aspects, the amino-dPEG$_n$-acid compounds in the calibration composition can be produced by mixing an assortment of amino-dPEG$_n$ and acid-dPEG$_n$ of discrete masses. The calibration composition can further include, but is not limited to, 7-aminoheptanoic acid (which can be commercially obtained from Sigma-Aldrich), clomipramine (which can be commercially obtained from Sigma-Aldrich), reserpine (which can be commercially obtained from Sigma-Aldrich), phosphazene 921 (which can be commercially obtained from Apollo Scientific Ltd.), phosphazene, 1521 (which can be commercially obtained from Apollo Scientific Ltd.), and sulfinpyrazone (which can be commercially obtained from Sigma-Aldrich).

In various embodiments, in calibrating an APCI mass spectrometer in positive ionization mode, the polyethylene glycol compounds comprise amino-dPEG 4-acid, amino-dPEG 6-acid, amino-dPEG 8-acid, and amino-dPEG 12-acid. In various embodiments, the calibrant further comprises 7-aminoheptanoic acid, clomipramine, reserpine, phosphazene 921, and phosphazene 1521.

Figure 3:
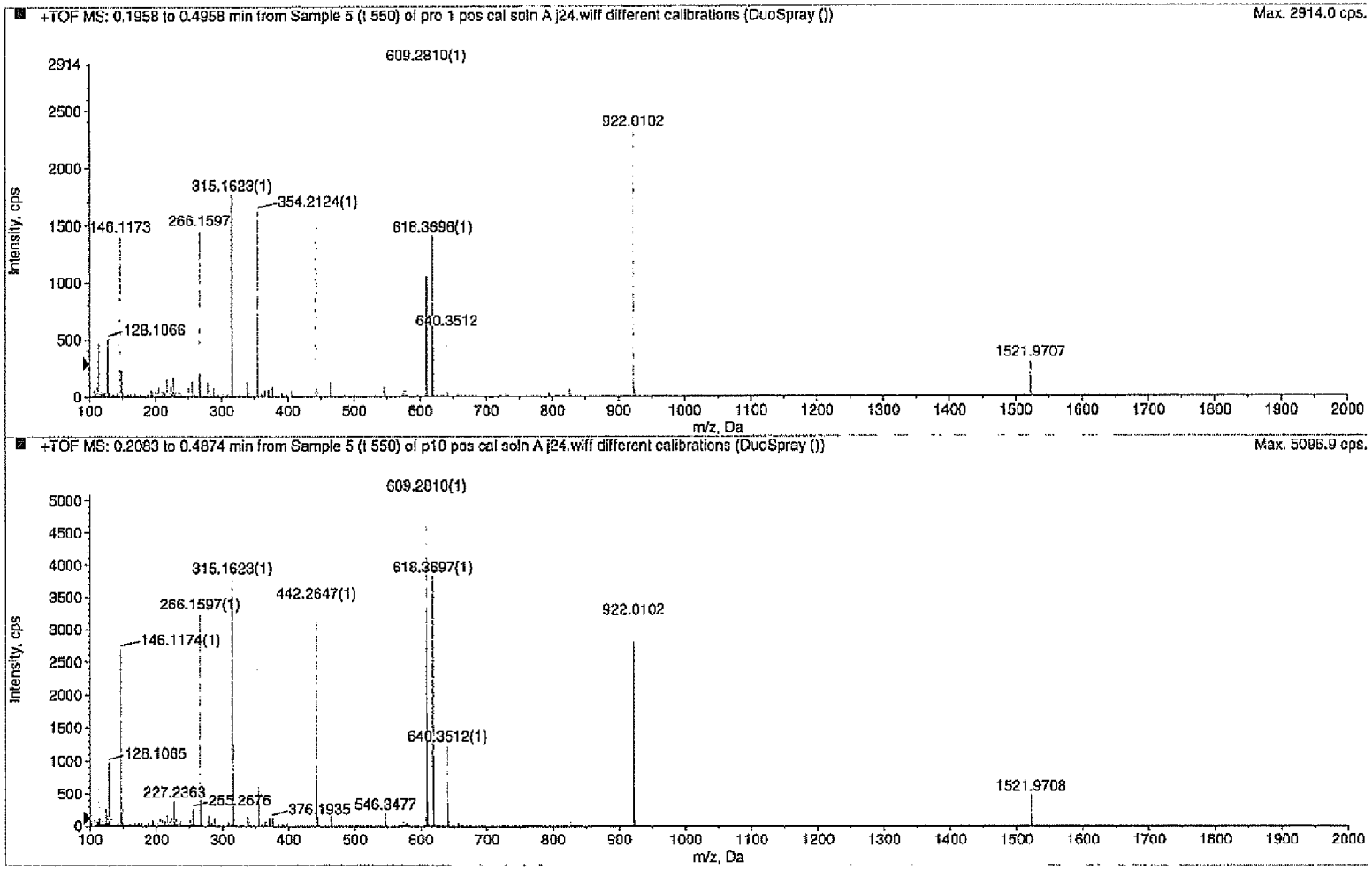
FIG. 3 shows mass spectra of a calibrant composition obtained using a mass spectrometer with an APCI ion source in positive ionization mode in accordance with various embodiments of the applicants' teachings.
Figure 4:
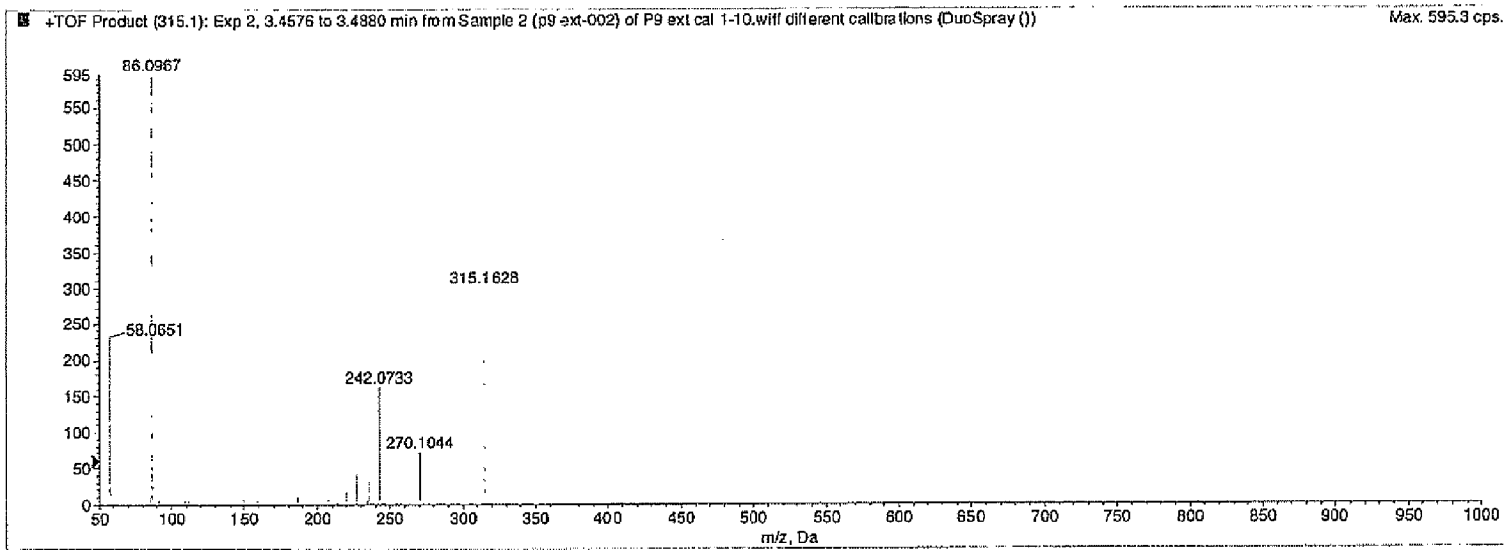
FIG. 4 shows an MS/MS mass spectra of clomipramine obtained with an APCI source in positive ionization mode in accordance with various embodiments of the applicants' teachings.
Figure 5:
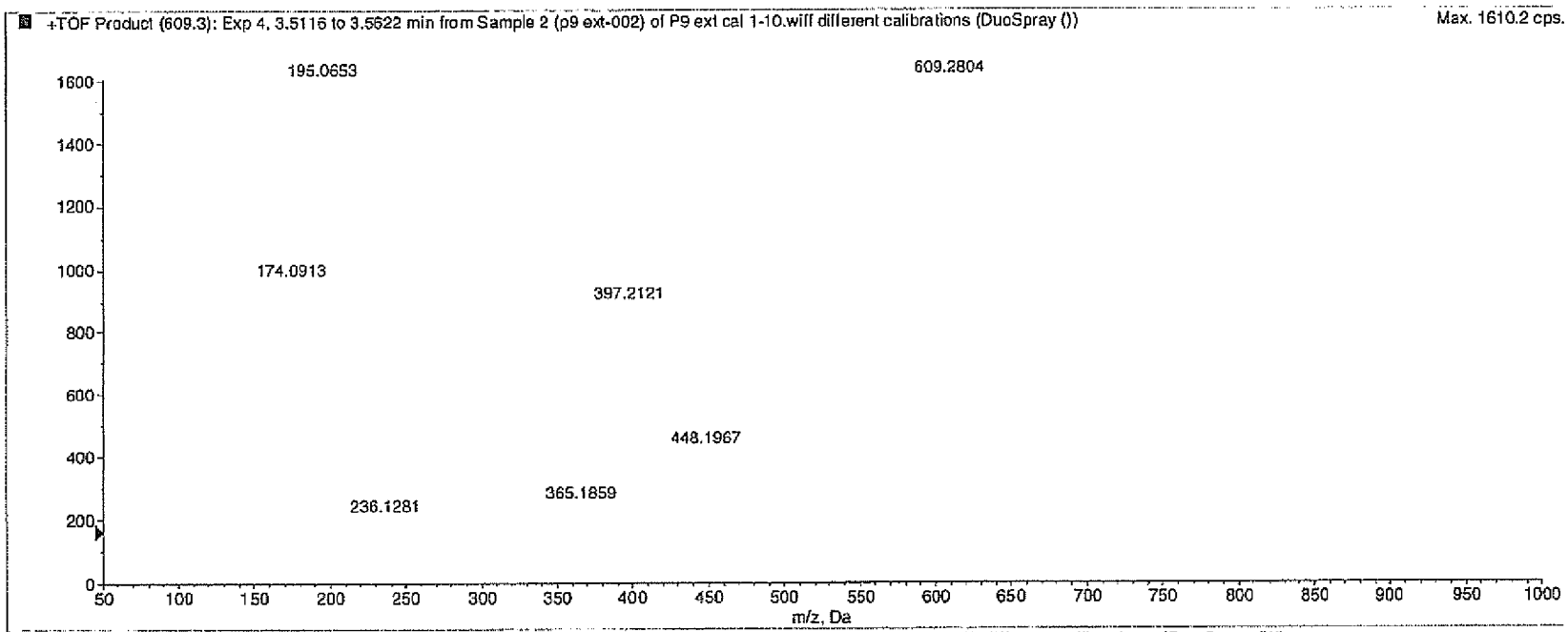
FIG. 5 shows an MS/MS mass spectra of reserpine obtained with an APCI source in positive ionization mode in accordance with various embodiments of the applicants' teachings.
Figure 6:
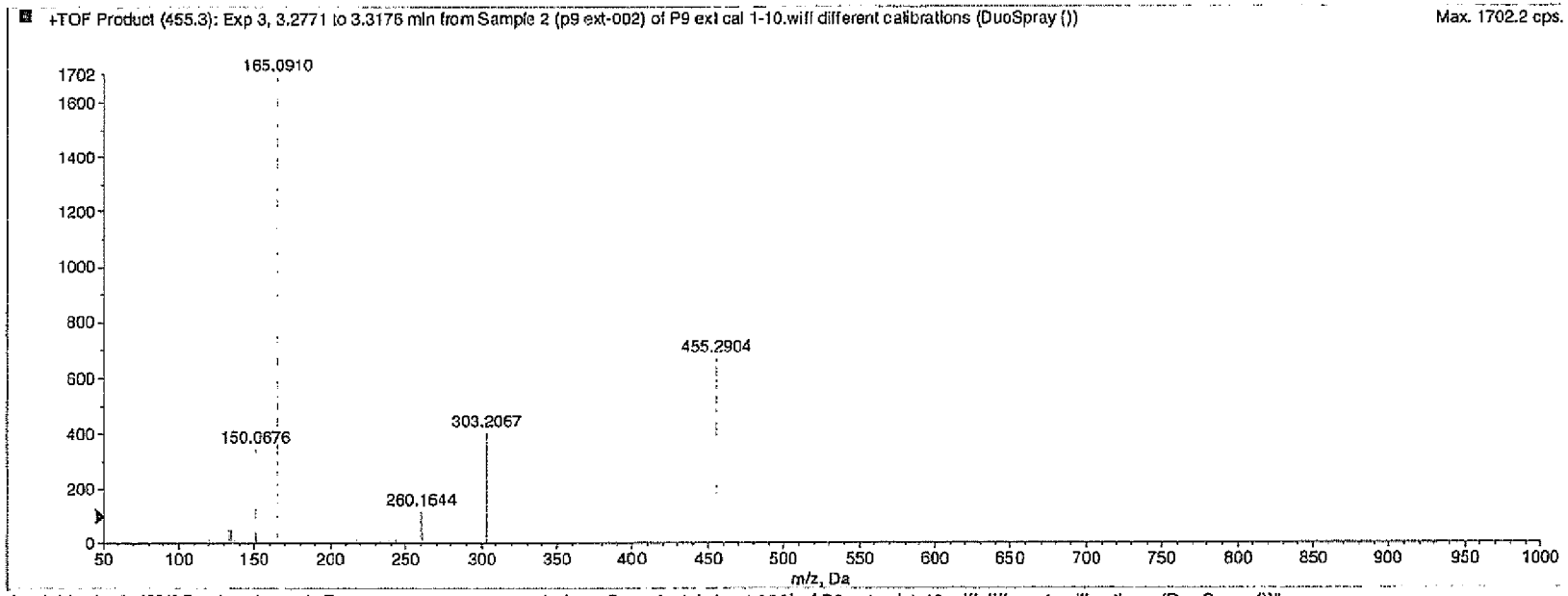
FIG. 6 shows an MS/MS mass spectra of verapamil obtained with an APCI source in positive ionization mode in accordance with various embodiments of the applicants' teachings.
Figure 7:
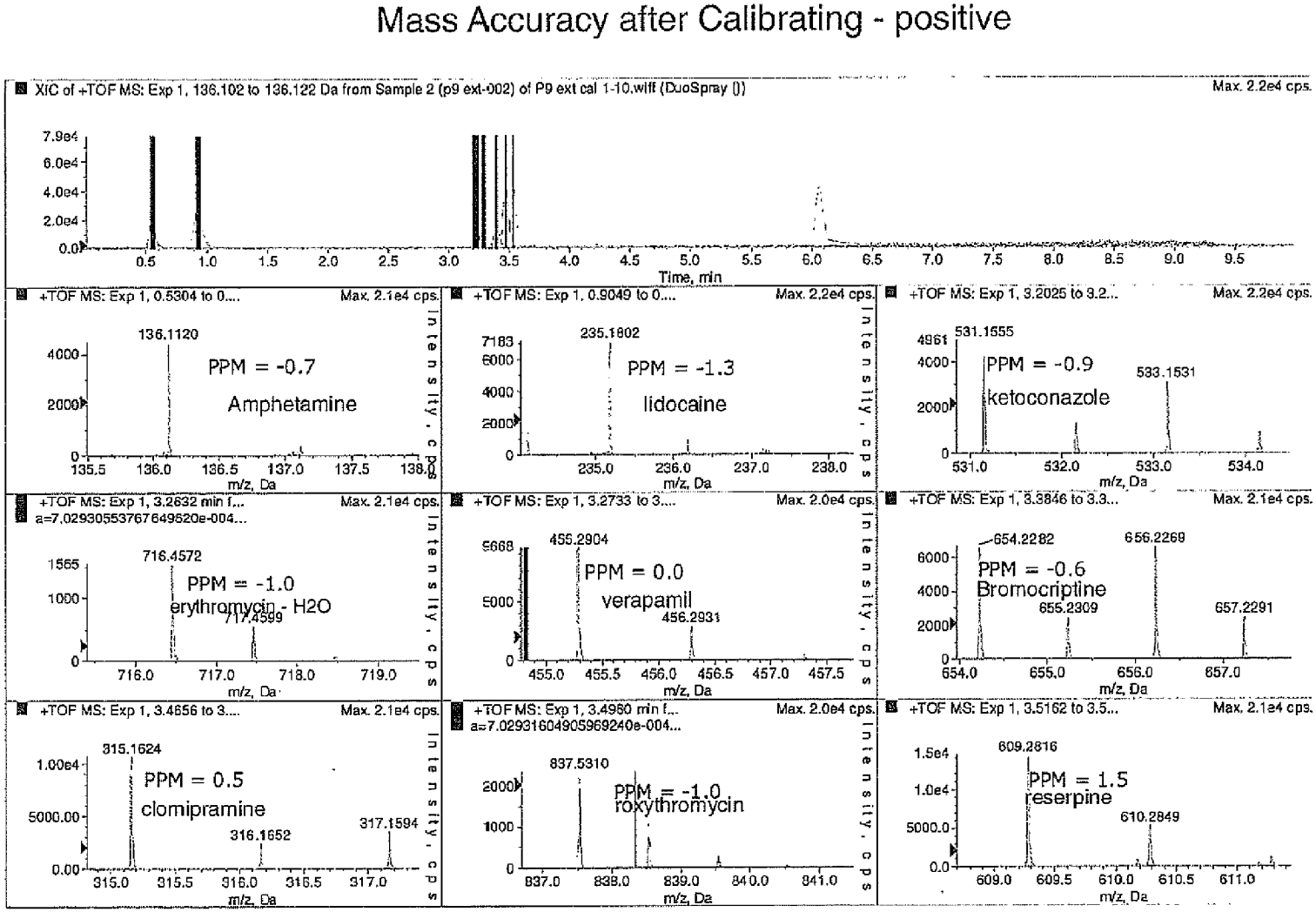
FIG. 7 shows mass spectra of various compounds after calibrating with a calibrant composition using an APCI ion source in positive ionization mode in accordance with various embodiments of the applicants' teachings.

In various embodiments, a calibration composition for use in APCI mass spectrometry calibration in positive ionization mode was prepared comprising the components in FIG. 2. FIG. 3 shows the mass spectra of the calibration composition obtained in APCI positive ionization mode from two instruments according to various embodiments of the applicant's teachings. In various aspects, FIG. 4 shows an MS/MS spectrum obtained for clomipramine in positive ionization mode following an autotune calibration with the APCI calibration composition prepared in FIG. 2. The individual mass peaks found closely agreed with the target mass peaks as shown in the table in FIG. 4. FIG. 5 shows an MS/MS spectrum obtained for reserpine in positive ionization mode following an autotune calibration with the APCI calibration composition prepared in FIG. 2. The individual mass peaks found closely agreed with the target mass peaks as shown in the table in FIG. 5. FIG. 6 shows an MS/MS spectrum obtained for verapamil in positive ionization mode following an autotune calibration with the APCI calibration composition prepared in FIG. 2. The individual mass peaks found closely agreed with the target mass peaks as shown in the table in FIG. 6. According to various embodiments of the applicant's teachings, FIG. 7 shows the mass accuracy obtained for various compounds in positive ionization mode following an autotune calibration with the APCI calibration composition prepared in FIG. 2.

In various aspects, in calibrating an APCI mass spectrometer in negative ionization mode, the polyethylene glycol compounds comprise amino-dPEG 4-acid, amino-dPEG 6-acid, amino-dPEG 8-acid, amino-dPEG 12-acid, and amino-dPEG 16-acid. In various embodiments, the calibrant composition further comprises 7-aminoheptanoic acid and sulfinpyrazone.

Figure 9:
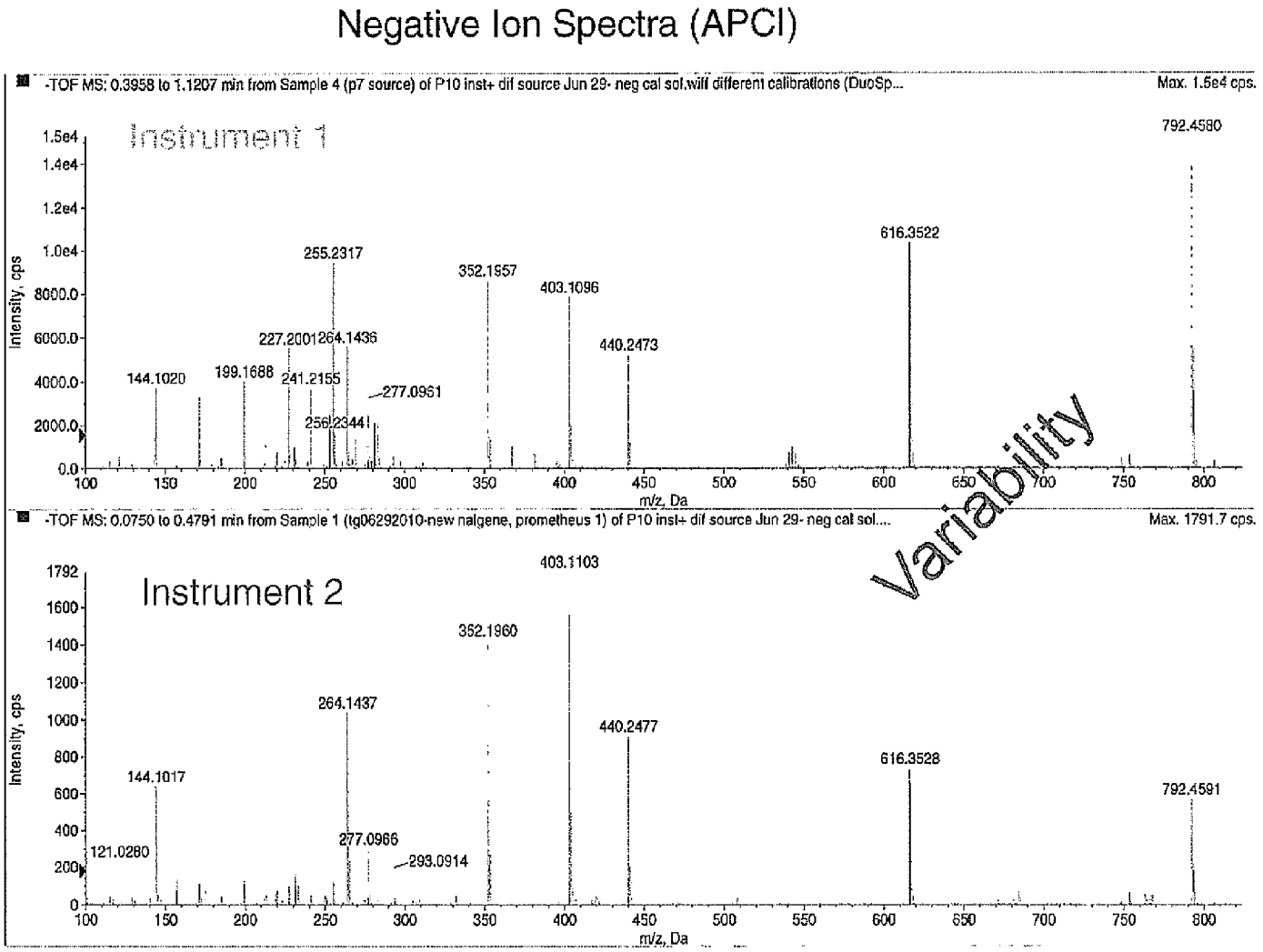
FIG. 9 shows mass spectra of a calibrant composition obtained using a mass spectrometer with an APCI ion source in negative ionization mode in accordance with various embodiments of the applicants' teachings.
Figure 10:
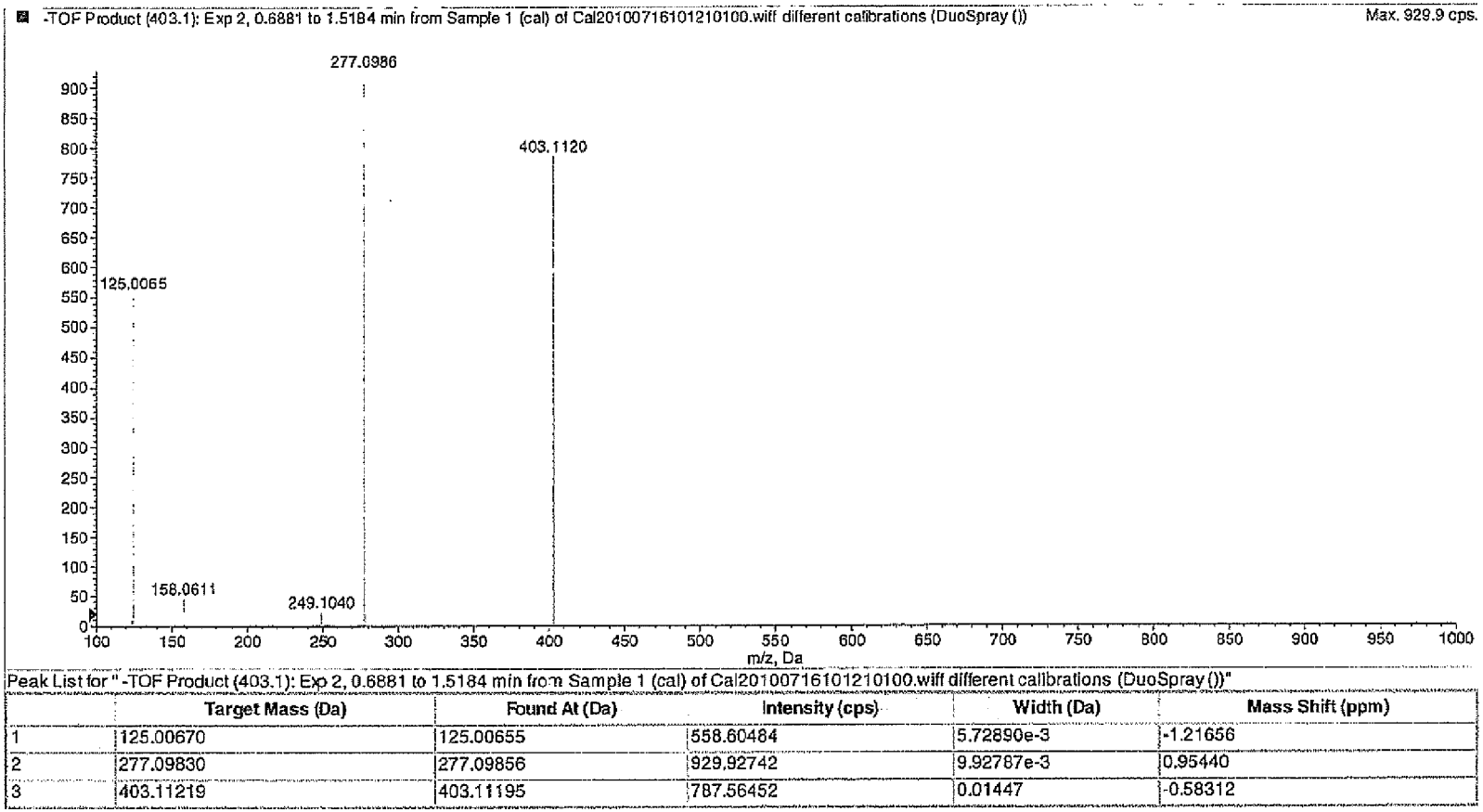
FIG. 10 shows an MS/MS mass spectra of sulfinpyrazone obtained with an APCI source in negative ionization mode in accordance with various embodiments of the applicants' teachings.
Figure 11:
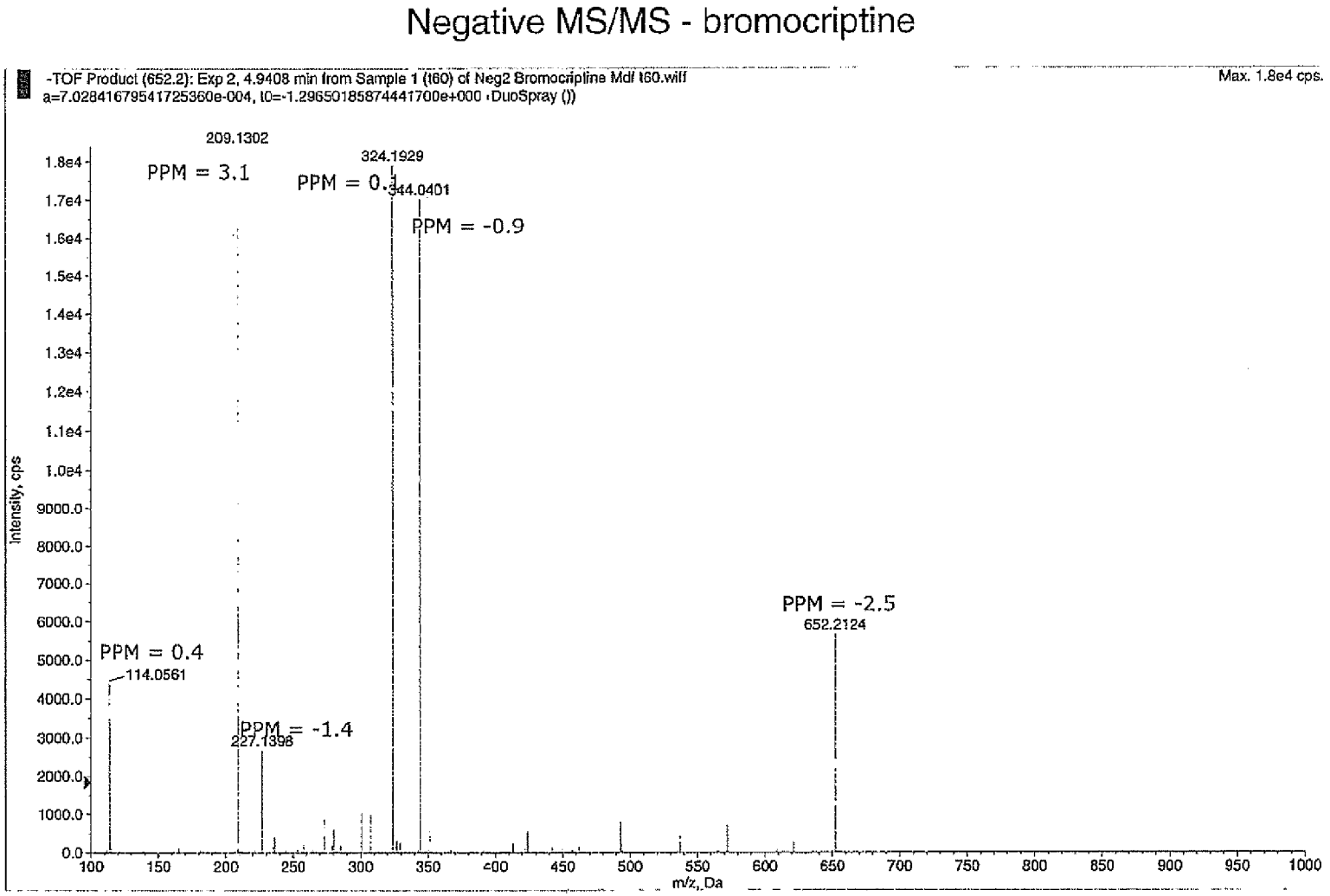
FIG. 11 shows an MS/MS mass spectra of bromocriptine obtained with an APCI source in negative ionization mode in accordance with various embodiments of the applicants' teachings.
Figure 12:
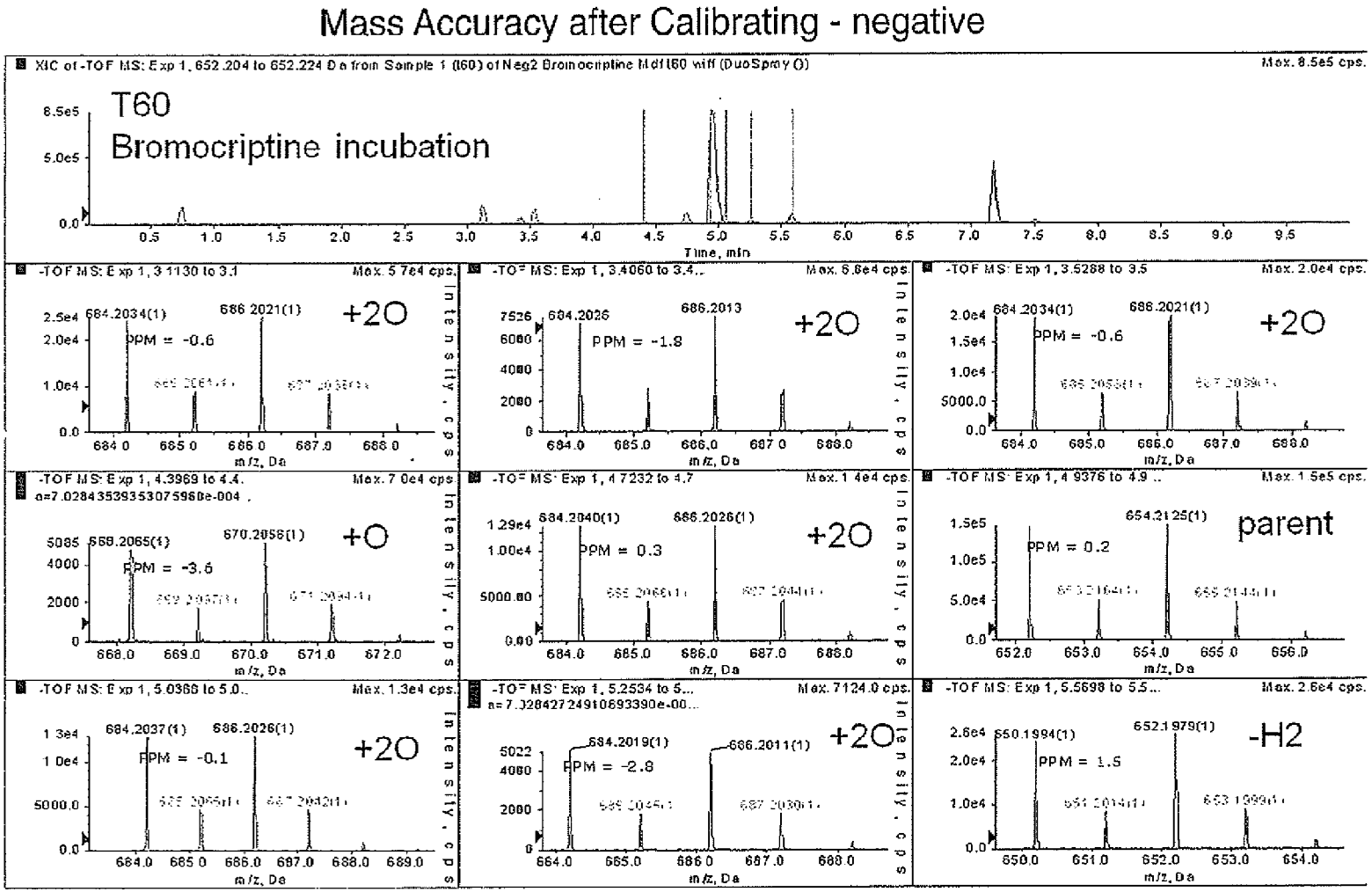
FIG. 12 shows mass spectra of Bromocriptine after calibrating with a calibrant composition using an APCI ion source in negative ionization mode in accordance with various embodiments of the applicants' teachings.

In various embodiments, a calibration composition for use in APCI mass spectrometry calibration in negative ionization mode was prepared comprising the components in FIG. 8. FIG. 9 shows the mass spectra of the calibration composition obtained in APCI negative ionization mode from two instruments according to various embodiments of the applicant's teachings. In various aspects, FIG. 10 shows an MS/MS spectrum obtained for sulfinpyrazone in negative ionization mode following an autotune calibration with the APCI calibration composition prepared in FIG. 8. The individual mass peaks found closely agreed with the target mass peaks as shown in the table in FIG. 10. FIG. 11 shows an MS/MS spectrum obtained for bromocriptine in negative ionization mode following an autotune calibration with the APCI calibration composition prepared in FIG. 8. The individual mass peaks found closely agreed with the target mass peaks as shown in FIG. 11. According to various embodiments of the applicant's teachings, FIG. 12 shows the mass accuracy obtained for bromocriptine in negative ionization mode following an autotune calibration with the APCI calibration composition prepared in FIG. 8.

In various embodiments, in calibrating an electrospray mass spectrometer in positive ionization mode, the polyethylene glycol compounds comprise amino-dPEG 4-acid, amino-dPEG 6-acid, amino-dPEG 8-acid, and amino-dPEG 12-acid. In various embodiments, the calibrant further comprises 7-aminoheptanoic acid clomipramine, reserpine, phosphazene 921, and phosphazene 1521.

Figure 14:
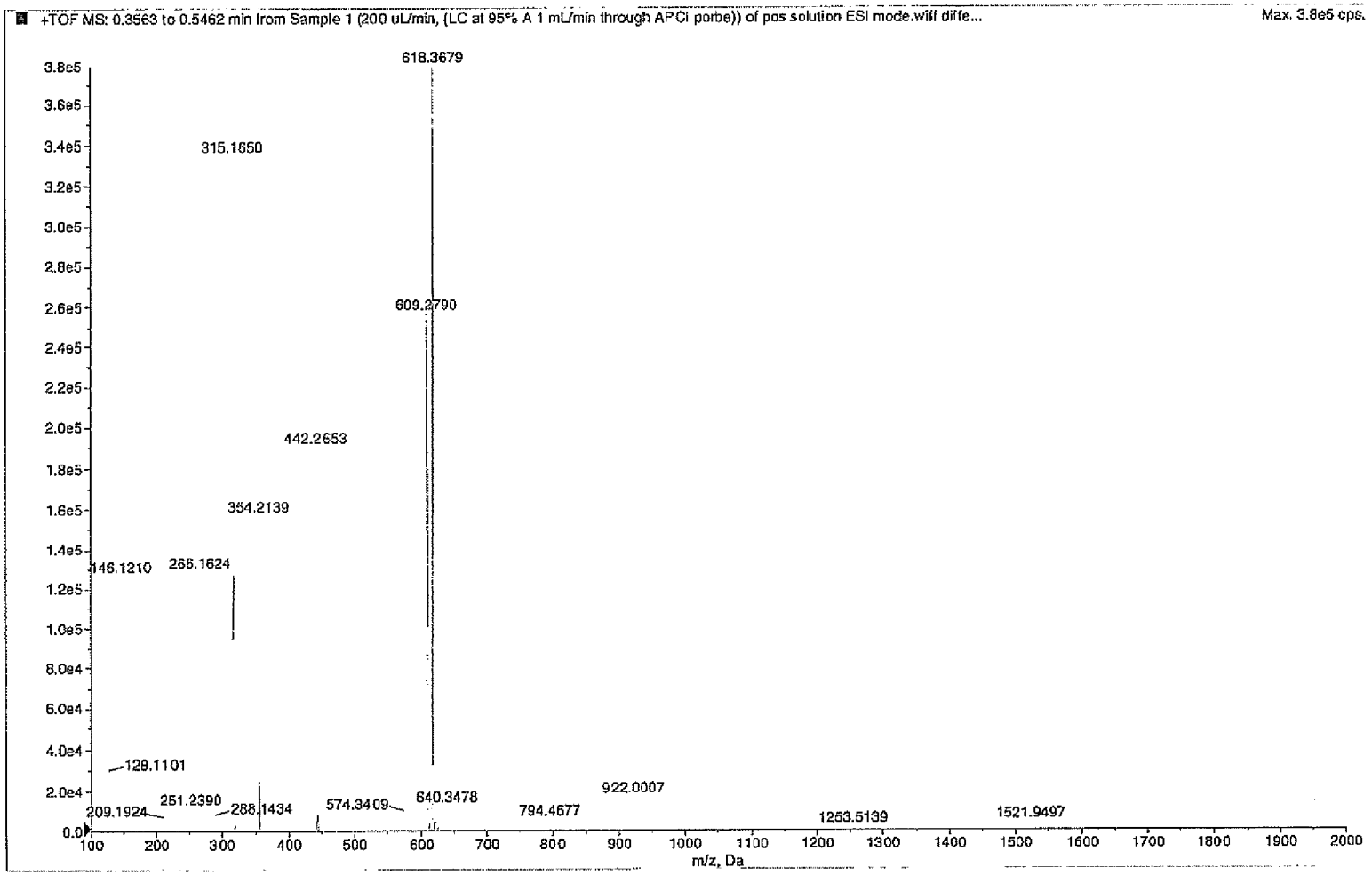
FIG. 14 shows mass spectra of a calibrant composition obtained using a mass spectrometer with an ESI ion source in positive ionization mode in accordance with various embodiments of the applicants' teachings.
Figure 15:
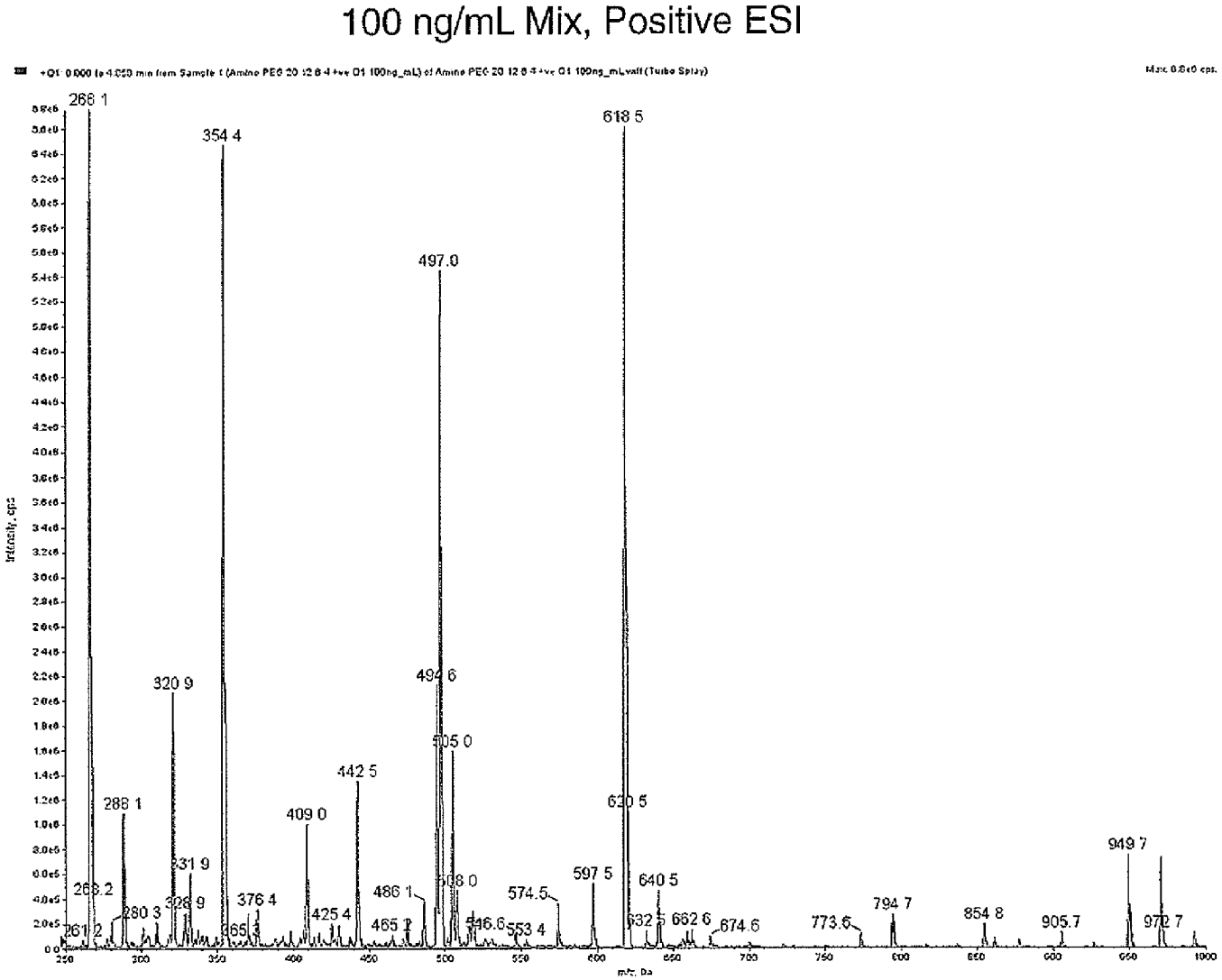
FIG. 15 shows mass spectra of a calibrant composition obtained using a mass spectrometer with an ESI ion source in positive ionization mode in accordance with various embodiments of the applicants' teachings.

In various embodiments, a calibration composition for use in electrospray mass spectrometry calibration in positive ionization mode was prepared comprising the components in FIG. 13. FIG. 14 shows the mass spectrum of the calibration composition obtained in electrospray positive ionization mode according to various embodiments of the applicant's teachings. In various aspects, FIG. 15 shows the mass spectrum obtained from a 100 ng/mL mixture of calibration composition in electrospray positive ionization mode.

In various embodiments, in calibrating an electrospray mass spectrometer in negative ionization mode, the polyethylene glycol compounds comprise amino-dPEG 4-acid, amino-dPEG 6-acid, amino-dPEG 8-acid, amino-dPEG 12-acid, and amino-dPEG 16-acid. In various embodiments, the calibrant further comprises 7-aminoheptanoic acid and sulfinpyrazone.

Figure 17:
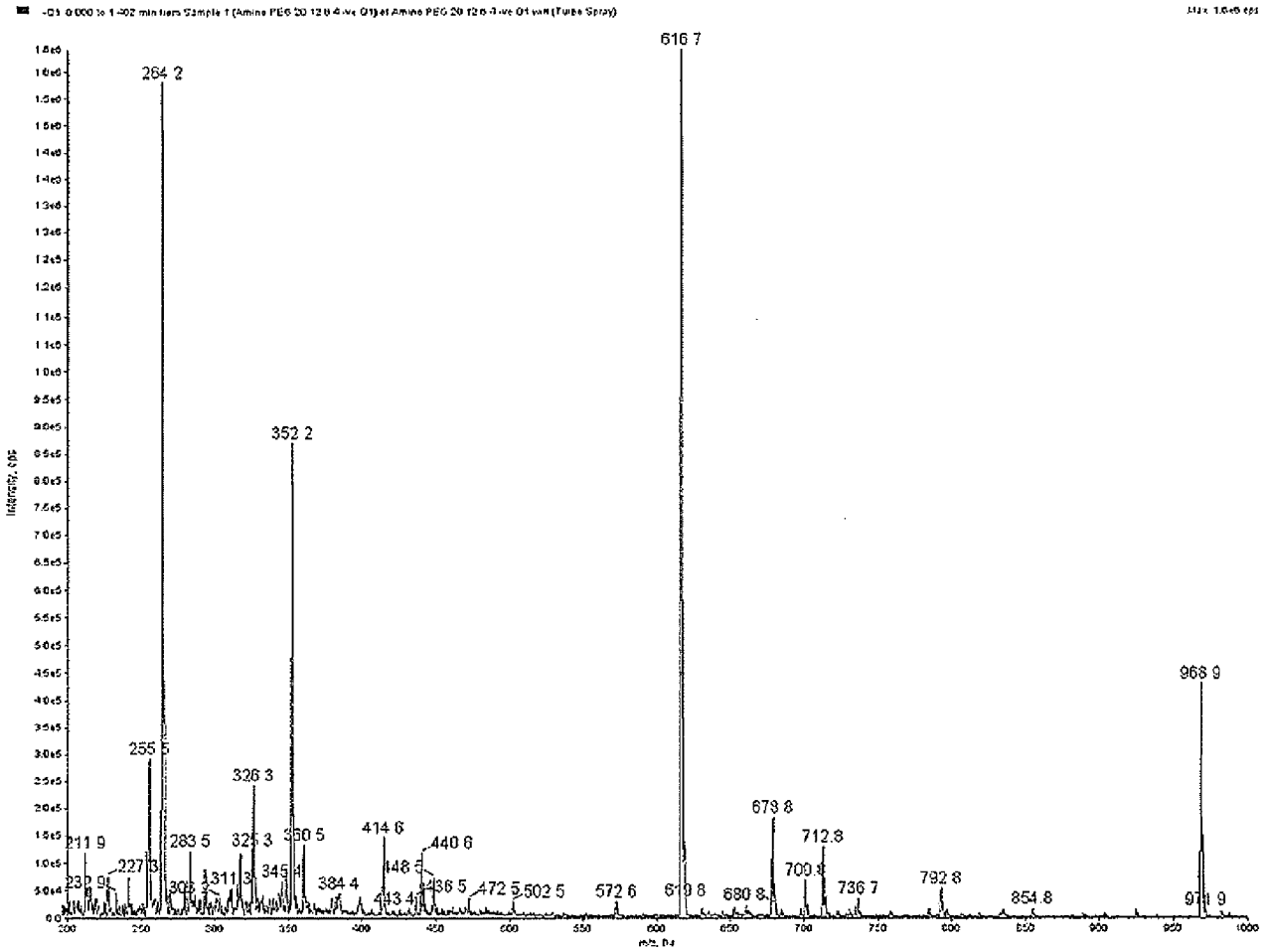
FIG. 17 shows mass spectra of a calibrant composition obtained using a mass spectrometer with an ESI ion source in negative ionization mode in accordance with various embodiments of the applicants' teachings.
Figure 18:
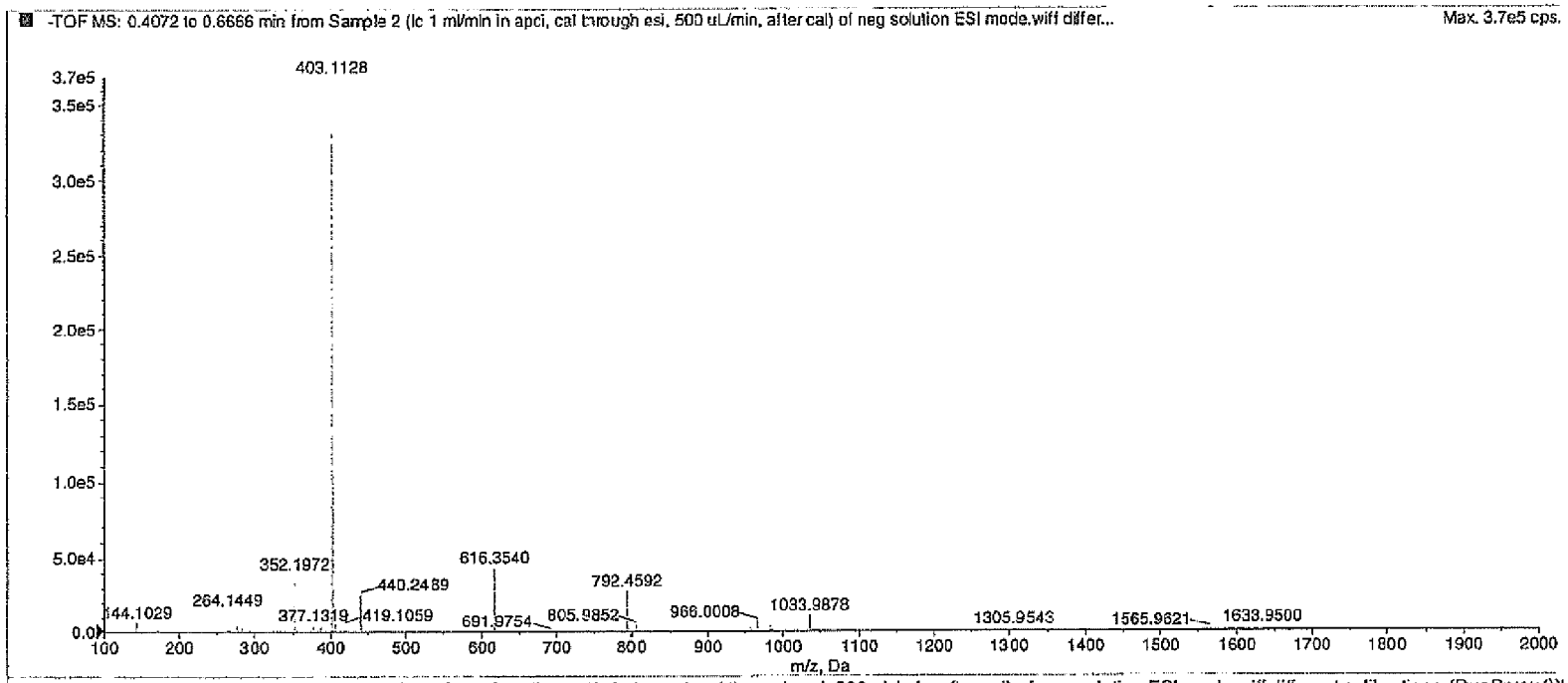
FIG. 18 shows mass spectra of a calibrant composition obtained using a mass spectrometer with an ESI ion source in negative ionization mode in accordance with various embodiments of the applicants' teachings.

In various embodiments, a calibration composition for use in electrospray mass spectrometry calibration in negative ionization mode was prepared comprising the components in FIG. 16. FIG. 17 shows the mass spectrum of the calibration composition obtained in electrospray negative ionization mode according to various embodiments of the applicant's teachings. FIG. 18 shows a spectrum obtained in negative ionization mode following an autotune calibration with the ESI calibration composition prepared in FIG. 16. The individual mass peaks found closely agreed with the target mass peaks as shown in the table in FIG. 18.

Figure 19:
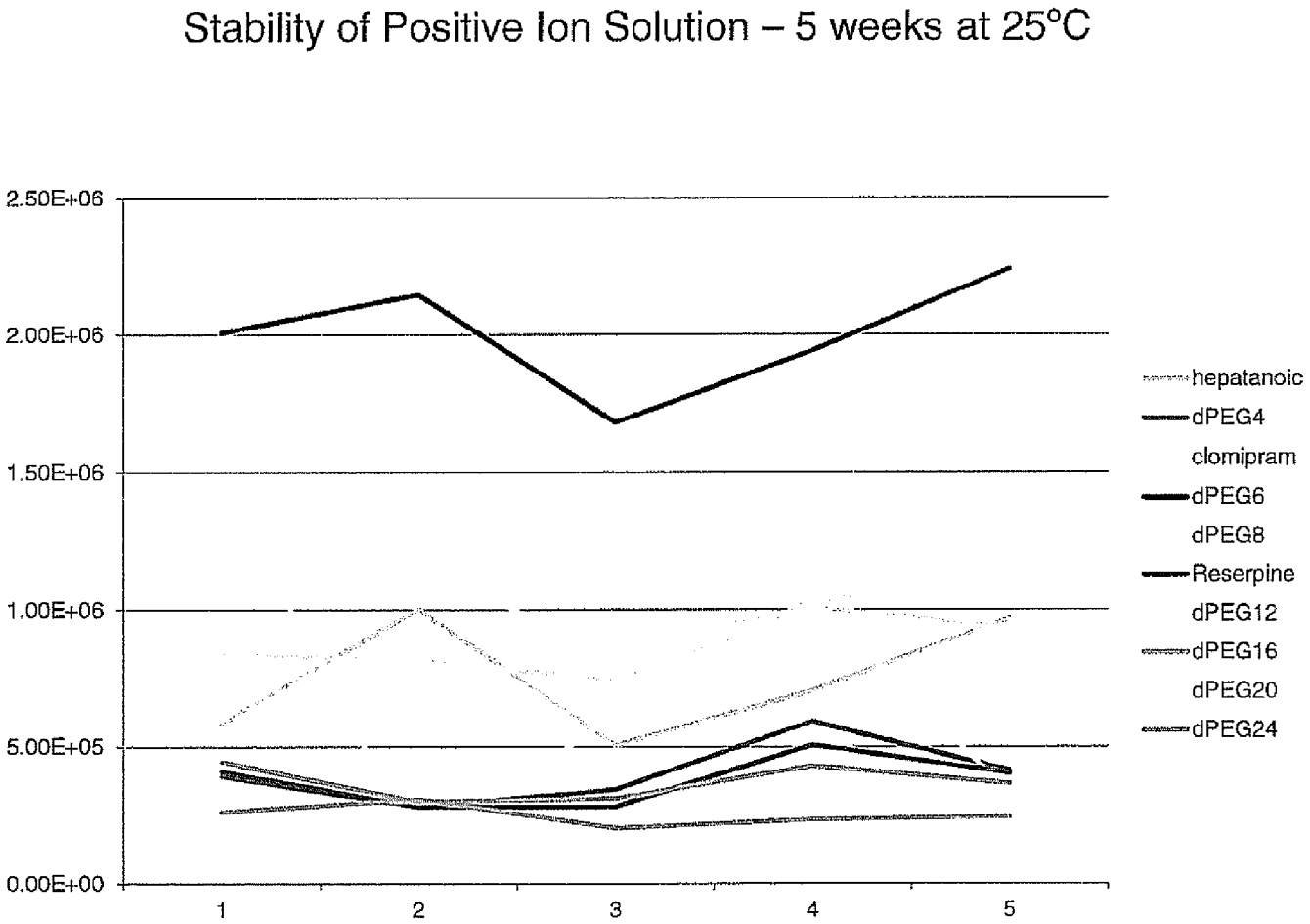
FIG. 19 illustrates the stability of a calibrant composition in positive ionization mode in accordance with various embodiments of the applicants' teachings.
Figure 20:
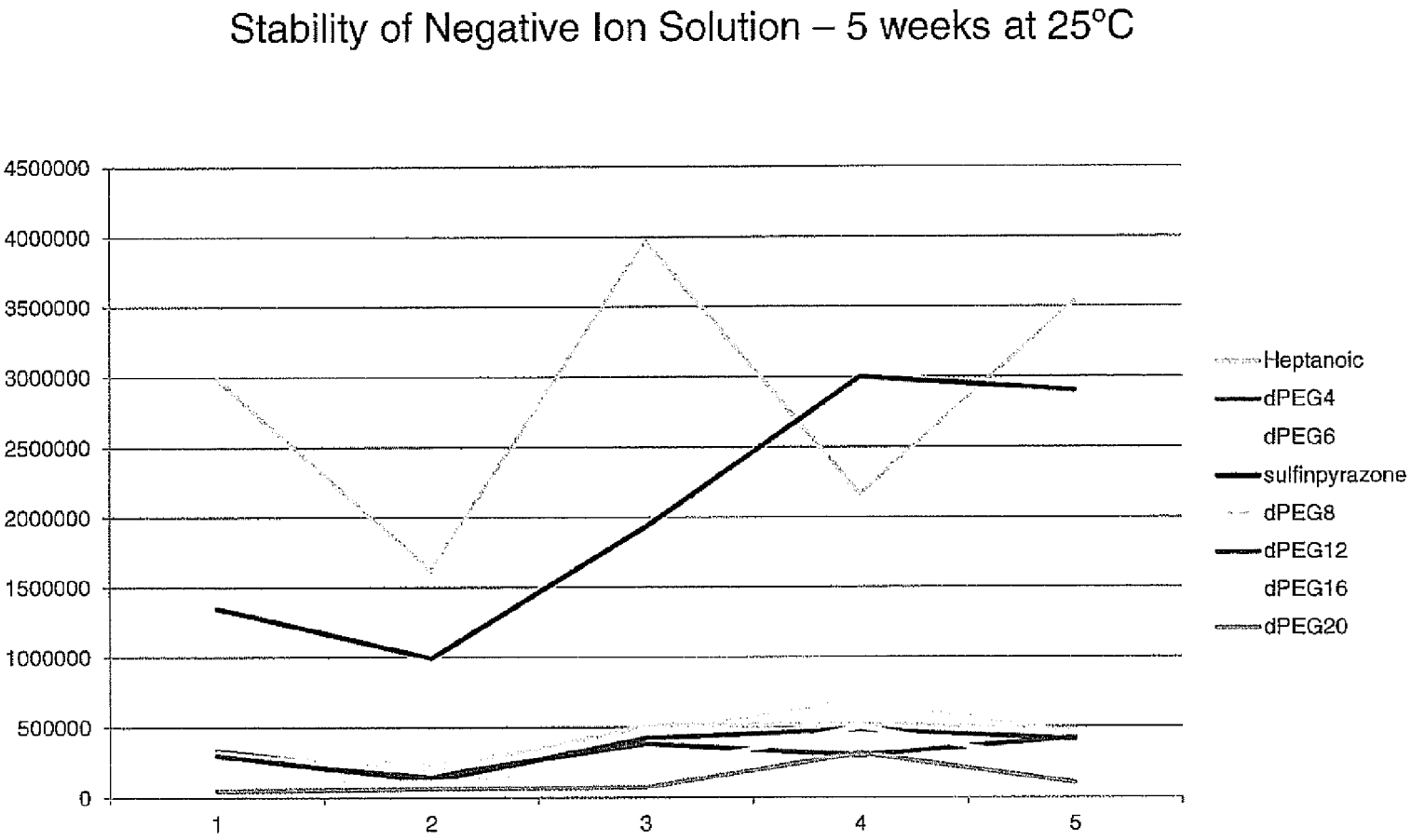
FIG. 20 illustrates the stability of a calibrant composition in negative ionization mode in accordance with various embodiments of the applicants' teachings.

According to various embodiments of the applicant's teachings, FIG. 19 shows the stability of the positive ion calibration solution during a span of five weeks at a temperature of 25 degrees Celsius. FIG. 20 shows the stability of the negative ion calibration solution during a span of five weeks at a temperature of 25 degrees Celsius according to various embodiments of the applicant's teachings.

In various embodiments, solvents can be used to dissolve the calibrant and can include, but are not limited to, acetonitrile, methanol, ethanol, propanol, isopropanol, or water. In various aspects, the solvent can comprise a mixture of acetronitrile and water.

In various aspects, the calibration composition can be used as an internal standard to optimize and tune parameters of the mass spectrometer to ensure that accurate mass spectra are obtained. In use, a mass spectrum of a calibrant composition can be obtained. The calibrant composition can include a plurality of known compounds comprising a mixture of amino acid polyethylene glycol compounds and a solvent for dissolving the calibrant. The differences between the expected mass peaks for the known compounds and the corresponding mass peaks obtained can be determined and the mass spectrometer can be adjusted based on the differences between the expected and actual mass peaks. In various aspects, the calibrant can be used in either positive or negative ionization mode, and the calibrant can be used in calibrating an APCI or an electrospray mass spectrometer.

In various embodiments, in calibrating an APCI mass spectrometer in positive ionization mode, the polyethylene glycol compounds can comprise amino-dPEG 4-acid, amino-dPEG 6-acid, amino-dPEG 8-acid, and amino-dPEG 12-acid. In various embodiments, the calibrant can further comprise 7-aminoheptanoic acid, clomipramine, reserpine, phosphazene 921, and phosphazene 1521.

In various embodiments, in calibrating an APCI mass spectrometer in negative ionization mode, the polyethylene glycol compounds can comprise amino-dPEG 4-acid, amino-dPEG 6-acid, amino-dPEG 8-acid, amino-dPEG 12-acid, and amino-dPEG 16-acid. In various aspects, the calibrant can further comprise 7-aminoheptanoic acid and sulfinpyrazone.

In various embodiments, in calibrating an electrospray mass spectrometer in positive ionization mode, the polyethylene glycol compounds can comprise amino-dPEG 4-acid, amino-dPEG 6-acid, amino-dPEG 8-acid, and amino-dPEG 12-acid. In various aspects, the calibrant can further comprise 7-aminoheptanoic acid, clomipramine, reserpine, phosphazene 921, and phosphazene 1521.

In various embodiments, in calibrating an electrospray mass spectrometer in negative ionization mode, the polyethylene glycol compounds comprise amino-dPEG 4-acid, amino-dPEG 6-acid, amino-dPEG 8-acid, amino-dPEG 12-acid, and amino-dPEG 16-acid. In various aspects, the calibrant can further comprise 7-aminoheptanoic acid and sulfinpyrazone.

In various embodiments, solvents can be used to dissolve the calibrant and can include, but are not limited to, acetonitrile, methanol, ethanol, propanol, isopropanol, or water. In various aspects, the solvent can comprise a mixture of acetronitrile and water.

In various embodiments, the calibrant composition can include a mixture to enable calibration across a broad range of masses. In various aspects, the calibrant composition can enable calibration across a range of approximately 145 to 3500 Da.

In various embodiments, a kit for calibrating a mass spectrometer can be provided. The kit can comprise a predetermined concentration of a calibrant comprising a mixture of amino acid polyethylene glycol compounds and a solvent for dissolving the calibrant.

In various aspects, in calibrating an APCI mass spectrometer in positive ionization mode, the polyethylene glycol compounds in the kit can comprise amino-dPEG 4-acid, amino-dPEG 6-acid, amino-dPEG 8-acid, and amino-dPEG 12-acid. In various embodiments, the kit can further comprise 7-aminoheptanoic acid, clomipramine, reserpine, phosphazene 921, and phosphazene 1521.

In various embodiments, in calibrating an APCI mass spectrometer in negative ionization mode, the polyethylene glycol compounds in the kit can comprise amino-dPEG 4-acid, amino-dPEG 6-acid, amino-dPEG 8-acid, amino-dPEG 12-acid, and amino-dPEG 16-acid. In various aspects, the kit can further comprise 7-aminoheptanoic acid and sulfinpyrazone.

In various embodiments, in calibrating an electrospray mass spectrometer in positive ionization mode, the polyethylene glycol compounds in the kit can comprise amino-dPEG 4-acid, amino-dPEG 6-acid, amino-dPEG 8-acid, and amino-dPEG 12-acid. In various aspects, the kit can further comprise 7-aminoheptanoic acid, clomipramine, reserpine, phosphazene 921, and phosphazene 1521.

In various embodiments, in calibrating an electrospray mass spectrometer in negative ionization mode, the polyethylene glycol compounds in the kit can comprise amino-dPEG 4-acid, amino-dPEG 6-acid, amino-dPEG 8-acid, amino-dPEG 12-acid, and amino-dPEG 16-acid. In various aspects, the kit can further comprise 7-aminoheptanoic acid and sulfinpyrazone.

In various aspects, the kit can comprise a solvent to dissolve the calibrant. In various embodiments, the solvent can comprise a mixture of acetonitrile and water. In various embodiments, the kit can contain any suitable solvent.

In various embodiments, the calibrant composition can include a mixture to enable calibration across a broad range of masses. In various aspects, the kit can comprise a calibrant composition that can enable calibration across a range of approximately 145 to 3500 Da.

While the applicants' teachings are described in conjunction with various embodiments, it is not intended that the applicants' teachings be limited to such embodiments. On the contrary, the applicants' teachings encompass various alternatives, modifications, and equivalents, as will be appreciated by those skilled in the art.

The invention claimed is:

1. A method for calibrating a mass spectrometer comprising:

a) obtaining a mass spectrum of a calibrant composition containing a plurality of known compounds comprising a mixture of discrete length polyethylene glycol compounds, each having an amino group on one end, a number of ethylene oxide units, and a carboxylic acid group on the other end, and a solvent for dissolving the calibrant;

b) determining the differences between the expected mass peaks for the known compounds and the corresponding actual mass peaks obtained;

c) adjusting the mass spectrometer based on the differences between the expected and actual mass peaks.

2. The method of claim 1 wherein the calibrant is used in either positive or negative ionization mode.

3. The method of claim 2 wherein the calibrant is used in calibrating an atmospheric pressure chemical ionization or an electrospray mass spectrometer.

4. The method of claim 3 wherein in calibrating an atmospheric pressure chemical ionization mass spectrometer in positive ionization mode, the discrete length polyethylene glycol compounds comprise compounds containing 4, 6, 8 and 12 ethylene oxide units.

5. The method of claim 4 wherein the calibrant further comprises 7-aminoheptanoic acid, clomipramine, reserpine, phosphazene 921, and phosphazene 1521.

6. The method of claim 3 wherein in calibrating an atmospheric pressure chemical ionization mass spectrometer in negative ionization mode, the discrete length polyethylene glycol compounds comprise compounds containing 4, 6, 8, 12 and 16 ethylene oxide units.

7. The method of claim 6 wherein the calibrant further comprises 7-aminoheptanoic acid and sulfinpyrazone.

8. The method of claim 3 wherein in calibrating an electrospray mass spectrometer in positive ionization mode, the discrete length polyethylene glycol compounds comprise compounds containing 4, 6, 8 and 12 ethylene oxide units.

9. The method of claim 8 wherein the calibrant further comprises 7-aminoheptanoic acid, clomipramine, reserpine, phosphazene 921, and phosphazene 1521.

10. The method of claim 3 wherein in calibrating an electrospray mass spectrometer in negative ionization mode, the discrete length polyethylene glycol compounds comprise compounds containing 4, 6, 8, 12 and 16 ethylene oxide units.

11. The method of claim 10 wherein the calibrant further comprises 7-aminoheptanoic acid and sulfinpyrazone.

12. The method of claim 1 wherein the solvent comprises a mixture of acetronitrile and water.

13. The method of claim 1 wherein the calibrant mixture is selected to enable calibration across a range of approximately 145 to 3500 Da.

* * * * *